US005710391A

United States Patent [19]

Chetcuti

[11] Patent Number: 5,710,391

[45] Date of Patent: Jan. 20, 1998

[54] RECOIL REDUCER WAD FOR AMMUNITION

[76] Inventor: Francis Chetcuti, 3 St. Mary's Street, Tarxien, PLA 11, Malta

[21] Appl. No.: 631,867

[22] Filed: Apr. 12, 1996

Related U.S. Application Data

[63] Continuation of PCT/GB94/02228, Oct. 12, 1994, published as WO95/10752, Apr. 20, 1995.

[51] Int. Cl.[6] ..... F42B 5/26

[52] U.S. Cl. ..... 102/430; 102/437; 102/448; 102/469; 102/532

[58] Field of Search ..... 102/430, 437, 102/448–467, 469, 470, 532

[56] References Cited

U.S. PATENT DOCUMENTS

| | | | |
|---|---|---|---|
| 43,851 | 8/1864 | Howe | 102/469 |
| 97,537 | 12/1869 | Logan et al. | 102/469 |
| 3,229,634 | 1/1966 | Moehlman et al. | 102/467 |
| 3,359,906 | 12/1967 | Herter | 102/95 |
| 3,577,924 | 5/1971 | Findlay | 102/467 |
| 3,669,023 | 6/1972 | Moehlman et al. | 102/42 |
| 3,722,412 | 3/1973 | Herter | 102/43 |
| 4,063,511 | 12/1977 | Bullard | 102/448 |
| 4,151,799 | 5/1979 | Jackson | 102/95 |
| 4,506,605 | 3/1985 | Maki | 102/453 |
| 4,805,535 | 2/1989 | Marcon | 102/503 |
| 4,867,066 | 9/1989 | Buenemann, Jr. | 102/470 |
| 4,970,959 | 11/1990 | Bilsbury et al. | 102/450 |
| 5,127,331 | 7/1992 | Stoops | 102/467 |

FOREIGN PATENT DOCUMENTS

| | | | |
|---|---|---|---|
| 14512/66 | 5/1968 | Australia . | |
| 0 377 433 A1 | 1/1990 | European Pat. Off. . | |
| 0 435 830 A1 | 7/1991 | European Pat. Off. . | |
| 417,839 | 7/1910 | France . | |
| 1116967 | 5/1956 | France . | |
| 1186659 | 4/1959 | France . | |
| 1537421 | 8/1968 | France | 102/469 |
| 2 254 775 | 7/1975 | France . | |
| 2 362 362 | 3/1978 | France . | |
| 2 535 839 | 5/1984 | France . | |
| 78438 | 5/1894 | Germany . | |
| 306951 | 1/1917 | Germany . | |
| 1 453 837 | 5/1969 | Germany . | |
| 1 453863 | 7/1969 | Germany . | |
| 01235986 | 12/1992 | Italy . | |
| 2 013 843 a | 8/1979 | United Kingdom . | |

*Primary Examiner*—Harold J. Tudor
*Attorney, Agent, or Firm*—Zackery Legal Group

[57] ABSTRACT

Ammunition cartridges are disclosed comprising means for reducing recoil fed to a weapon on discharge of a cartridge. The recoil reducing means comprises non-supportive material between a propellant charge and an end plate of the cartridge in which energy can be absorbed. In a preferred embodiment, the recoil reducing means may comprise one or more toric, air-filled bodies of resilient material.

16 Claims, 7 Drawing Sheets

RECOIL REDUCER WAD FOR AMMUNITION

This is a continuation of the prior international PCT application Ser. No. PCT/GB94/02228 filed Oct. 12, 1994, published as WO95/10752, Apr. 20, 1995 the benefit of the filing date of which is hereby claimed under 35 U.S.C. §120.

The present invention relates to a device for reducing recoil in weapons. It is applicable to all types of weapons in which the ignition of gunpowder, or cordite, or the like, is employed to propel a projectile or projectiles in a forward direction.

A known shotgun cartridge is as shown in the accompanying FIG. 1. A casing 10 encloses, in sequence, a primer 12 held by an end cap 13, a charge 14, and wad 16, and a quantity of shot 18. The shot is retained in place by a cap 20. The cartridge is fired by striking the primer 12, causing ignition thereof and hence ignition of the charge 14. Gases are produced by this latter ignition under high pressure, which propel the rear face 22 of the wad 16 in a forward direction. This initially causes crushing of the wad 16 and then forward acceleration of the shot 18, and rupture of the cap 20. The purpose of wad 16 is to protect the shot 18 from too sudden acceleration.

Such cartridges are described in FR 2362362, FR 2251775, U.S. Pat. No. 4,151,799, and U.S. Pat. No. 3,722,412.

The present invention provides a round of ammunition containing within a casing a primer cartridge, a charge, and at least one projectile forward of the charge, wherein there is an unoccupied gap or a gap occupied by non-supportive material between the charge and the rear internal face of the round. It is preferred that the charge is enclosed within a jacket which has forward portion and a rear portion, adapted such that on ignition of the charge the rear portion of the jacket travels rearwards into the region between the charge and the rear internal face of the round where its kinetic energy is at least partly absorbed by a kinetic energy absorbing means. The kinetic energy absorbing means may comprise a tapered pillar projecting from a rear internal face of the round toward the rear jacket portion, and a corresponding opening in the rear jacket portion which fits about the tip of the column. Then, during rearward motion of the rear jacket portion, the opening is progressively widened by the tapered pillar and this deformation of the material immediately around the opening absorbs kinetic energy. Alternatively, or in addition, a crushable material can be provided in the space between the rear internal face of the round and the rear jacket portion. A suitable material is expanded polystyrene.

It is necessary to provide a striking face of the primer in the rear external face of the round, to allow actuation of the round by a firing pin. It is also necessary for the efflux of the primer to contact the charge in order to ignite it. To satisfy these design requirements, it is possible either to employ an elongate primer capable of extending from the rear face of the round to the charge, or to provide a duct to direct the efflux from the primer to the charge. Such a duct can be provided within the above-mentioned column. It is preferable that such a duct, where provided, is internally fluted to improve the flow of efflux from the primer.

To prevent "suck-back" of the rear jacket portion into the weapon barrel after firing, circumferential ribs can be provided on an internal face of the round or on an external surface of the column, (where provided). Thus, during rearward motion of the rear jacket portion under pressure of the propellent gases, the rear jacket portion passes over these ribs and is then retained against subsequent forward motion, preventing it from leaving the cartridge and becoming lodged in the barrel.

The present invention also provides, in a second aspect, a shotgun round having a charge, a quantity of shot, and an internal member for separating the charge and shot, the member being generally cylindrical and internally divided by a dividing member into a charge receiving region and a shot receiving region wherein either;

1. the cylindrical member has a circumferential recess on an outer face thereof in register with the dividing member, and the dividing member has an axially centred circular recess on a face thereof, or 2. the dividing member has an axially extending protrusion projecting into the charge receiving area.

The first option of the second aspect allows slight radial expansion and contraction of the member, which gives a better sealing action to the inside of the barrel during travel therealong, without excessive friction. The second option directs the efflux of the primer more evenly about the charge receiving area and hence gives better burning of the charge.

The second aspect of the present invention also relates to such an internal member per se, for use in the manufacture of a shotgun cartridge.

Embodiments of the present invention showing its application to shogun cartridges will now be described by way of example, with reference to the accompanying drawings. In is of course to be understood that the present invention is not limited to shotgun cartridges and is equally applicable to other types of ammunition.

In the drawings:

FIG. 1, already described, is a prior art shotgun cartridge;

FIGS. 3A and 4 are, respectively, a cross-sectional side view and a top view of the column and rear jacket portion according to a second embodiment of the present invention, while

FIGS. 5A and 6 are, respectively, part cross-sectional side view and a top view of a third embodiment of the present invention, while

In the Figures, like parts are denoted by like reference numerals.

Figure 1:
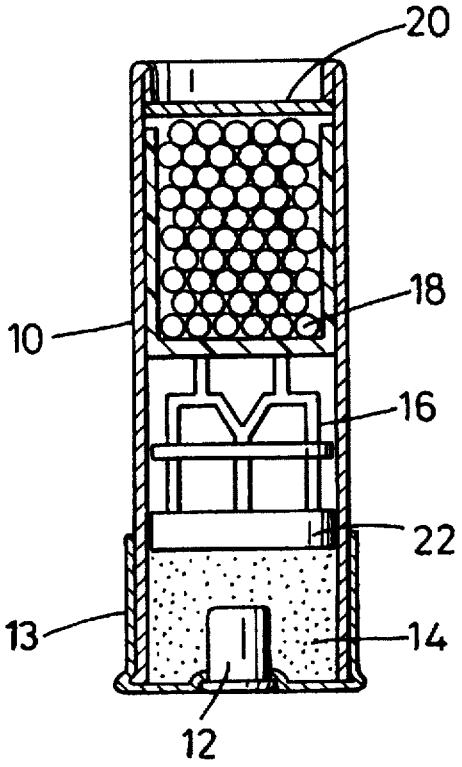
Fig. 1 (PRIOR ART)
Figure 2:
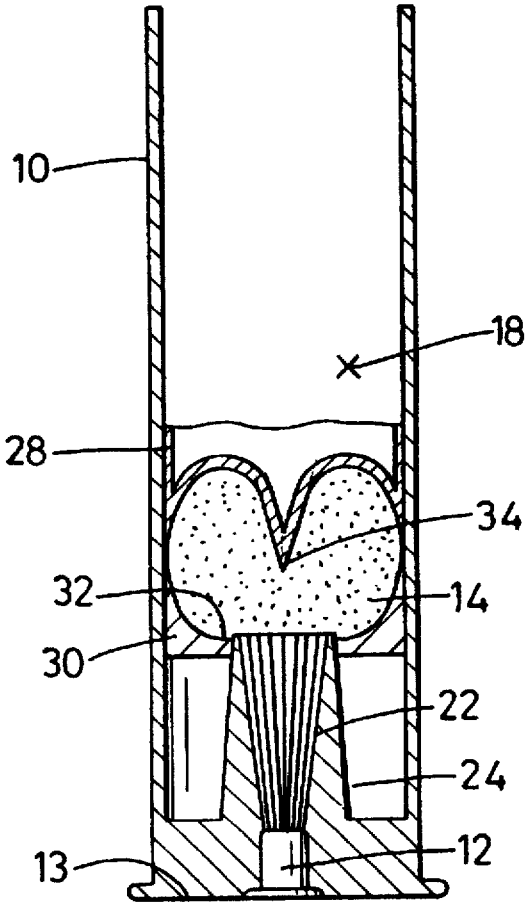
FIG. 2 is a cross-section through a shotgun cartridge according to a first embodiment of the present invention.

In the shotgun cartridge of the FIG. 2, a shotgun casing 10 has an end cap 13 holding a primer 12. The primer 12 communicates with an internally fluted duct 22 formed axially within a tapering column 24. The duct 22 leads to a charge 14 enclosed by a jacket consisting of a forward jacket portion 28 and rear jacket portion 30. The rear jacket portion 30 has an aperture 32 which fits snugly about the end of the column 24. The forward jacket portion 28 has a rearwardly directed axial projection 34 in the shape of a truncated circular pyramid. Ahead of the forward jacket portion 28 is a quantity of shot (not shown) in the region 18. The shot would normally be retained within the casing by a cap (not shown) similar to the cap 20 of FIG. 1.

The cartridge is fired by striking the external surface of the primer 12, causing explosion thereof. Flames travel along the duct 22 to the charge 14. The projection 34 promotes uniform distribution of the flames about the charge 14 and thus gives near simultaneous ignition of the entire charge. Expansion of the gases produced by ignition of the charge 14 drive the forward jacket portion forward and the rear jacket portion rearward. The forward motion of the forward jacket portion 28 causes expulsion of the shot in the conventional fashion. Rearward motion of the rear jacket portion 30 is gradually arrested by absorption of its kinetic energy through deformation of the opening 32 as it is driven down the taper of the column 24.

Hence, the rearward momentum corresponding to the forward momentum of the shot is transmitted to the rear jacket portion 30, rather than the weapon itself. Since the energy of this motion is absorbed in deformation of the jacket portion, a significantly reduced recoil is produced. Hence, a better shooting performance can be obtained due to decreased fatigue or nervousness on the part of the firer. Alternatively, a larger charge can be employed to give a greater muzzle velocity with no substantial increase in recoil over the prior art cartridge.

Various modifications and improvements are possible to the design of FIG. 2, which are illustrated in FIGS. 3A to 6.

Figure 3A:
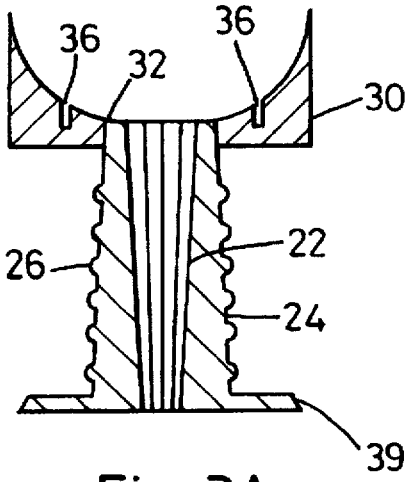
Figure 4:
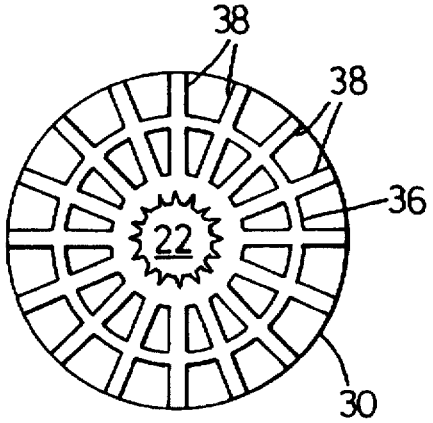
Figure 3B:
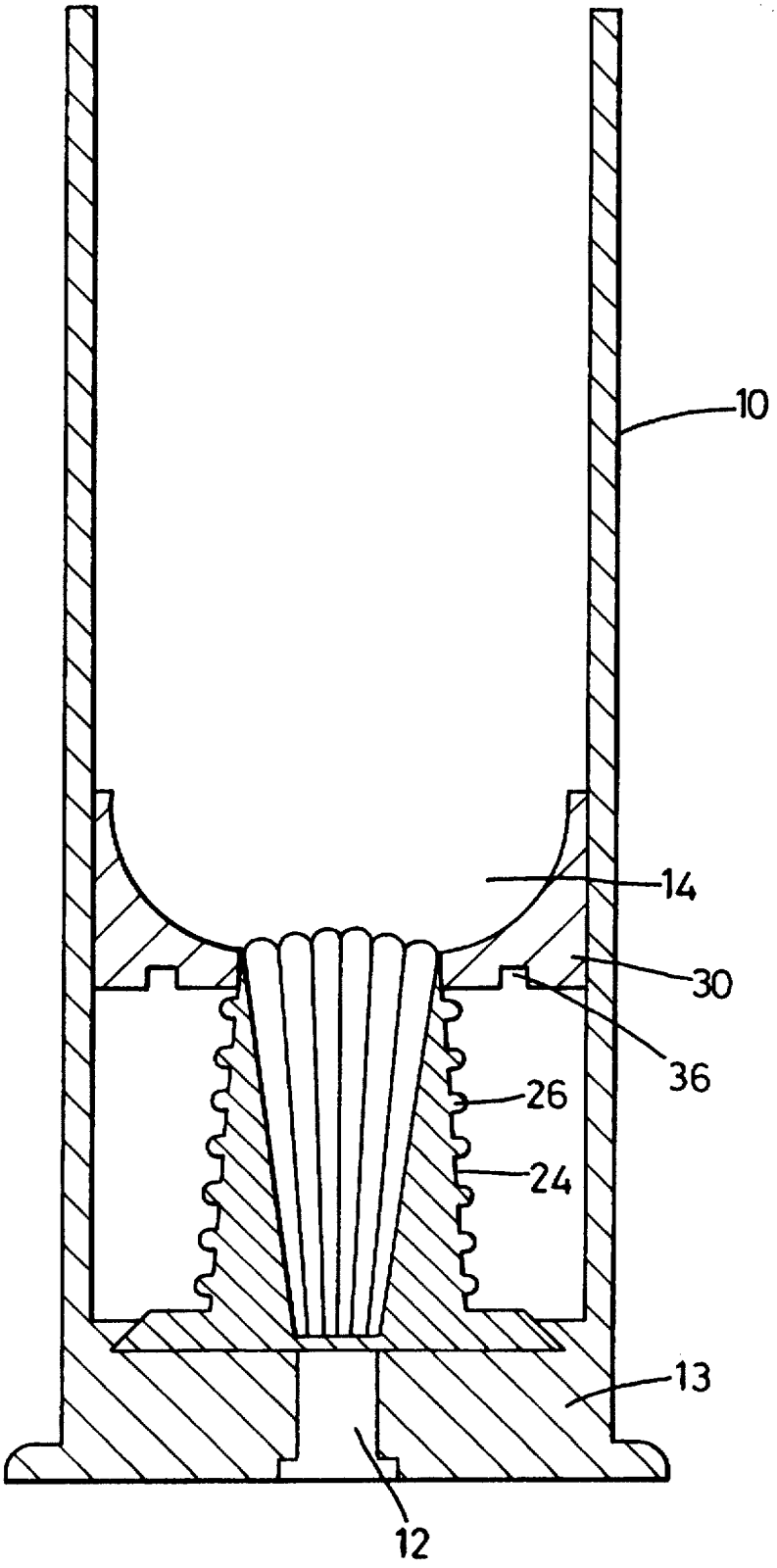
FIG. 3B is a cross-sectional side view of the column and rear jacket portion of FIG. 3A incorporated into a cartridge, the recess of the rear jacket portion being alternatively positioned.

In FIGS. 3A and 4, the forward surface of the rear jacket portion 30 has an axially centred ring-shaped recess 36 (an alternative being shown in FIG. 3B where the recess 36 is in rearward surface). This recess 36 increases the radial flexibility of the rear jacket portion 30, the effect of which is to take up the increase in diameter of the opening 32 without causing an increase in the overall diameter of the rear jacket portion 30. Thus, bulging of the cartridge during firing is inhibited, allowing easier removal of the cartridge from the barrel of the weapon. Also shown in FIG. 4 are radially extending grooves 38, which allow better distribution of the flames from the primer 12 about the charge 14.

Figure 5A:
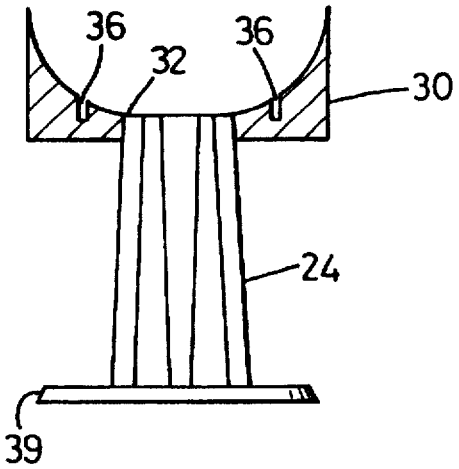
Figure 6:
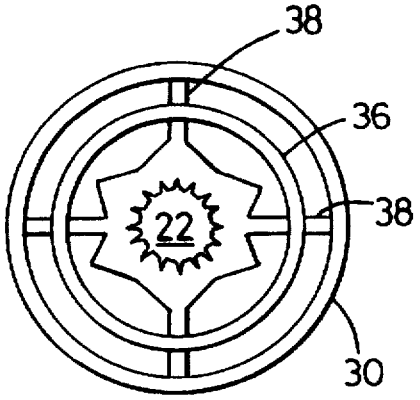
Figure 5B:
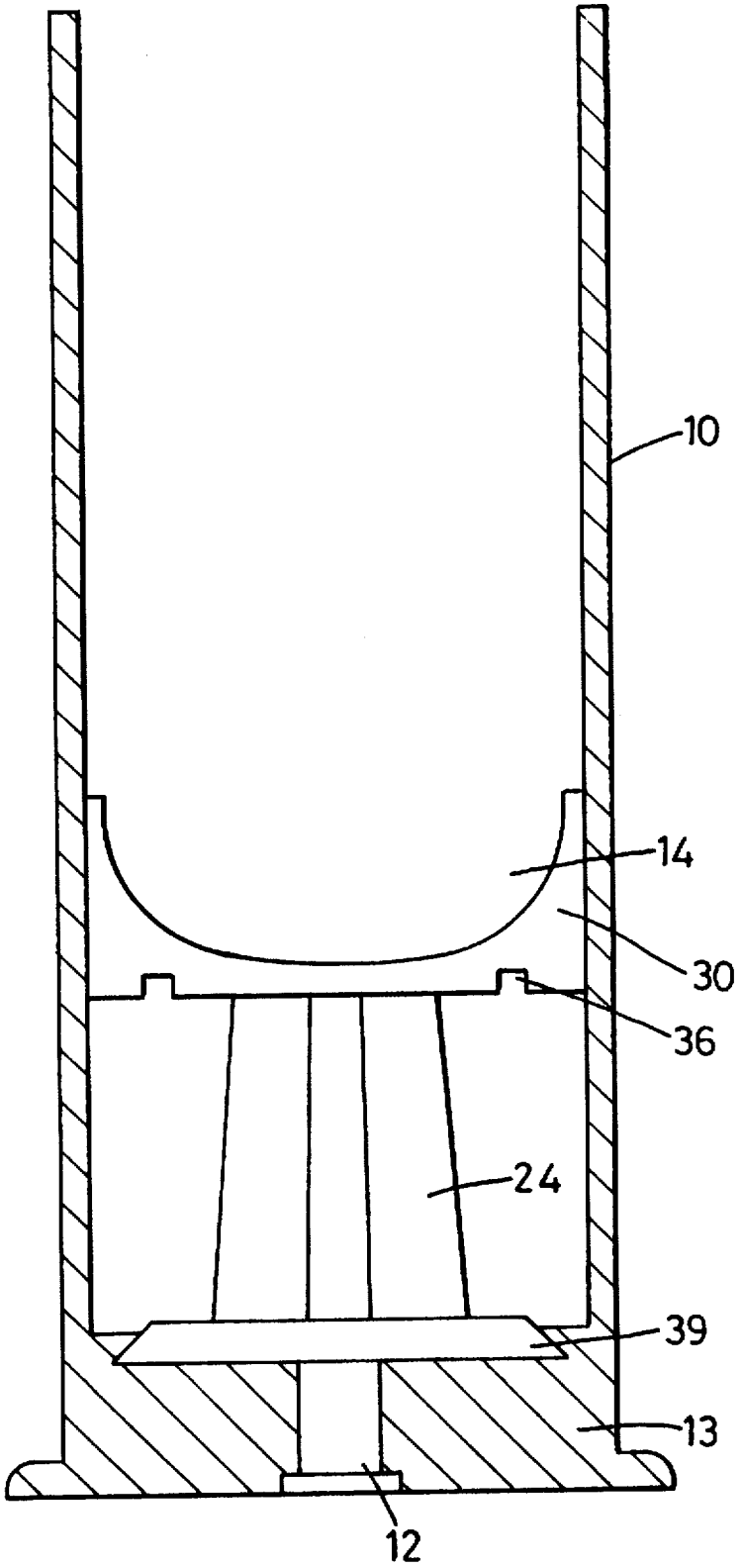
FIG. 5B is a cross-sectional side view of the embodiment of FIG. 3A incorporated into a cartridge, the recess of the rear jacket portion being alternatively positioned.

FIGS. 5A and 5B show an alternative to the circular-cross section column 24 of FIGS. 2 to 4, being a column of polygonal cross section (or of round cross section, this being particularly suited for manufacture by injection moulding), the column could conveniently be manufactured as an integral part of an injected, moulded or drawn shotgun cartridge.

Figure 7:
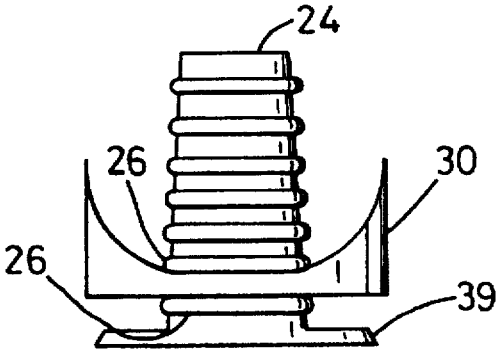
FIG. 7 is a side view of the column and rear jacket portion of the first and second embodiment of the present invention, after firing the of round.

FIG. 7 shows the column and rear jacket portion of FIGS. 3 and 4 after firing. As can be seen, the rear jacket portion 30 is retained against toward motion by the rib 26. Forward motion of the rear jacket portion 30 into the barrel of the weapon is undesirable since this could cause bulging of the barrel on firing of a further round.

It is, in fact, undesirable for any part of the recoil reducer to travel forward into the barrel of the weapon. Therefore, to anchor the column 24 to the base of the cartridge, the column 24 is formed with a dovetail section 39 which engages with a corresponding recess provided on an internal face of the cartridge.

Figure 13:
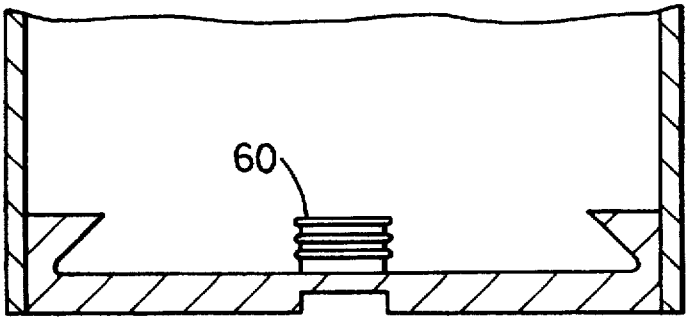

Additionally, as shown in FIG. 13, the primer 12 may be formed with external ribs 60 which engage and grip the inner wall of the duct 22 to further resist forward movement of the inner jacket portion, and/or the recoil device.

Figure 8:
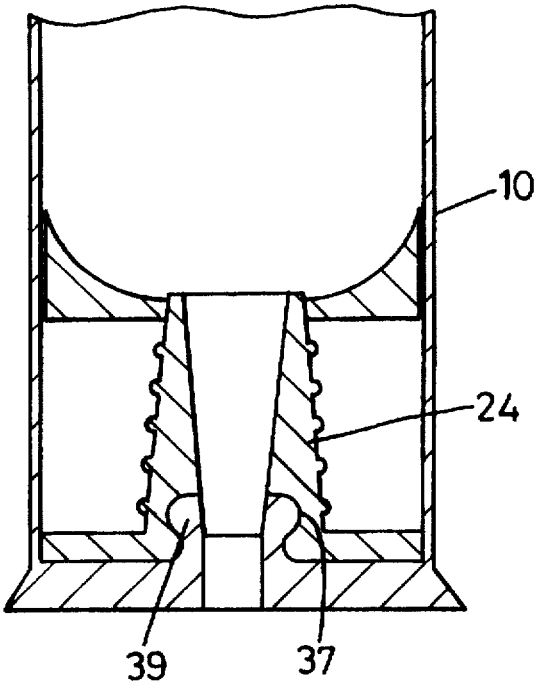
FIG. 8 is a cross-sectional view of the base portion of a cartridge, in a further embodiment.
Figure 9:
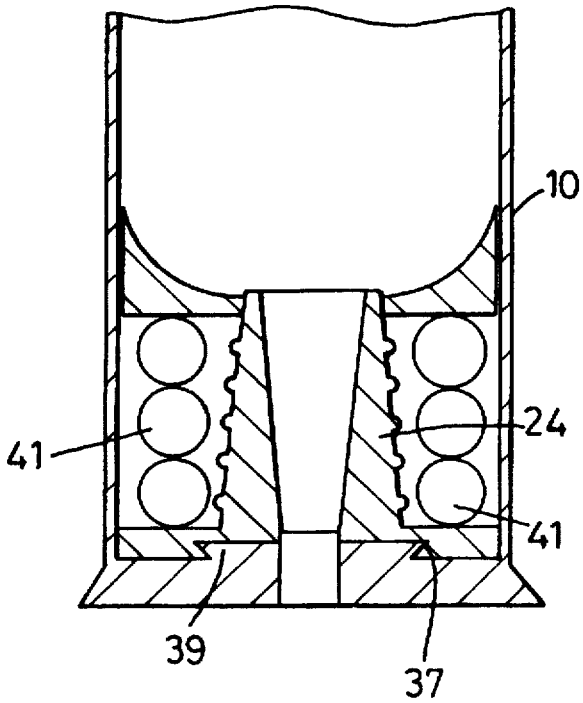
FIG. 9 is a cross-sectional view of the base portion of a cartridge, in a yet further embodiment.

FIGS. 8 and 9 show alternative arrangements for restraining forward motion of the column 24 into the barrel. In this arrangement, the column 24 has a recess 37 which fits around a corresponding annular dovetail 39 on the base of the cartridge. Alternatively, of course, the column 24 could be formed integrally with the cartridge 10, as shown in FIG. 2.

FIG. 9 also shows the use of hollow crushable rings of plastics within the region around the column 24, as an energy absorbing means. Alternatively, expanded polystyrene can be employed, as solid rings or spheres or the like.

Figure 10:
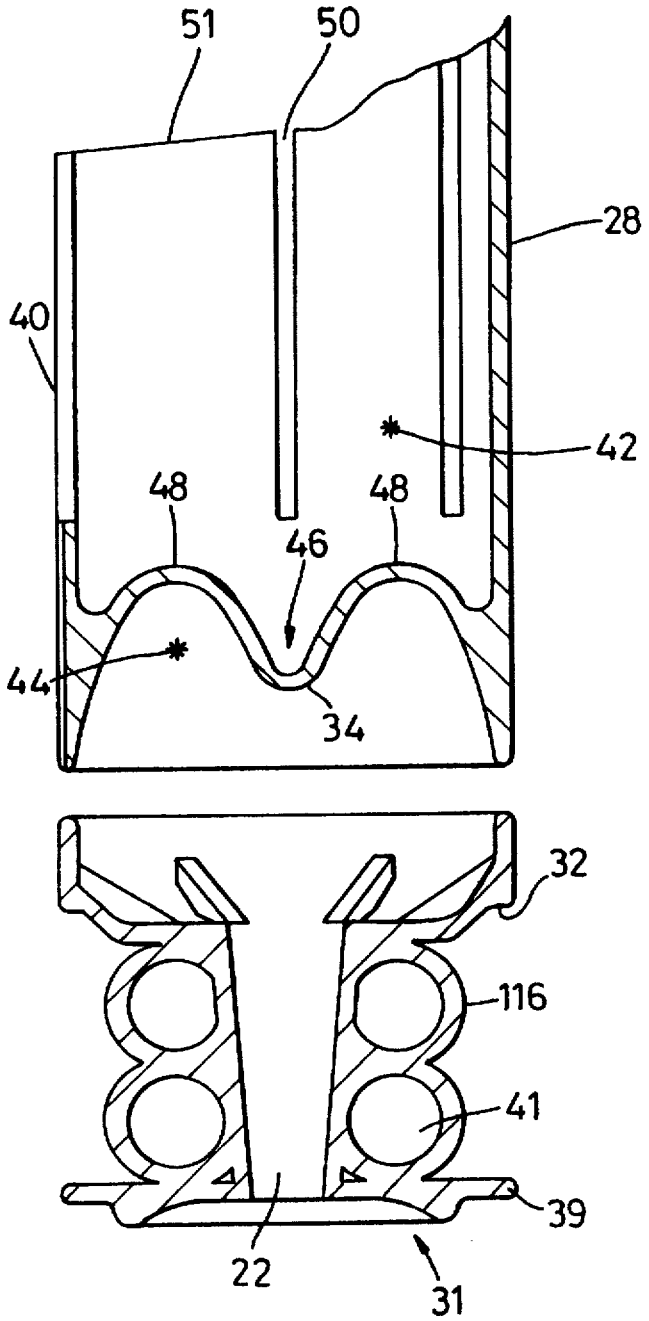
FIG. 10 is a sectional side view of a front jacket portion according to a fourth embodiment of the present invention.
Figure 11:
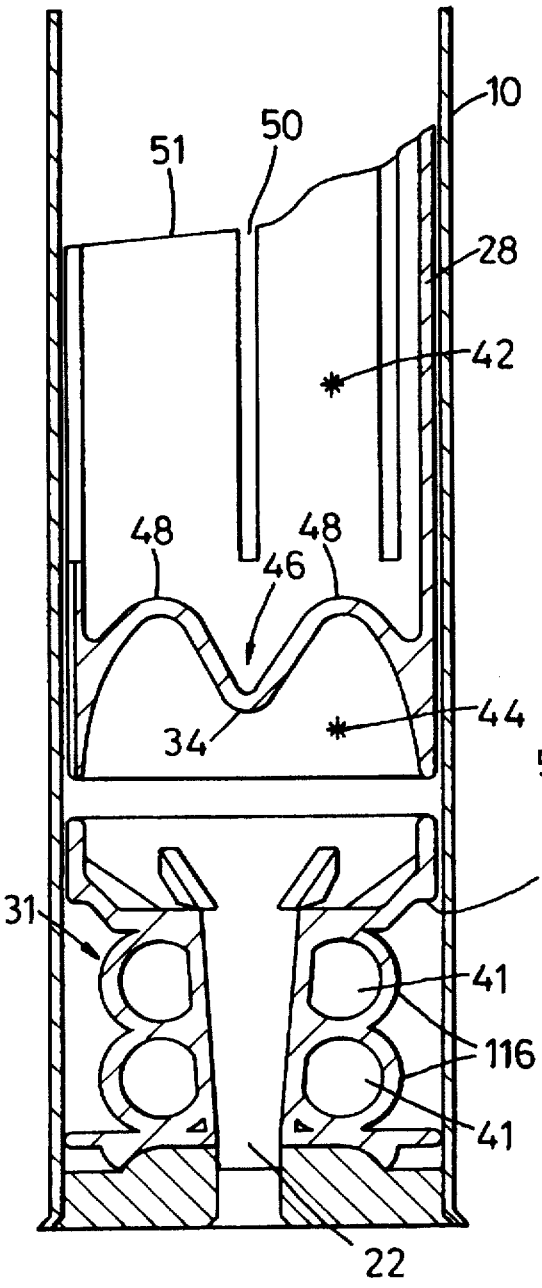
FIGS. 11 and 12 show alternative arrangements of the fourth embodiment incorporated into a shotgun cartridge.
Figure 12:
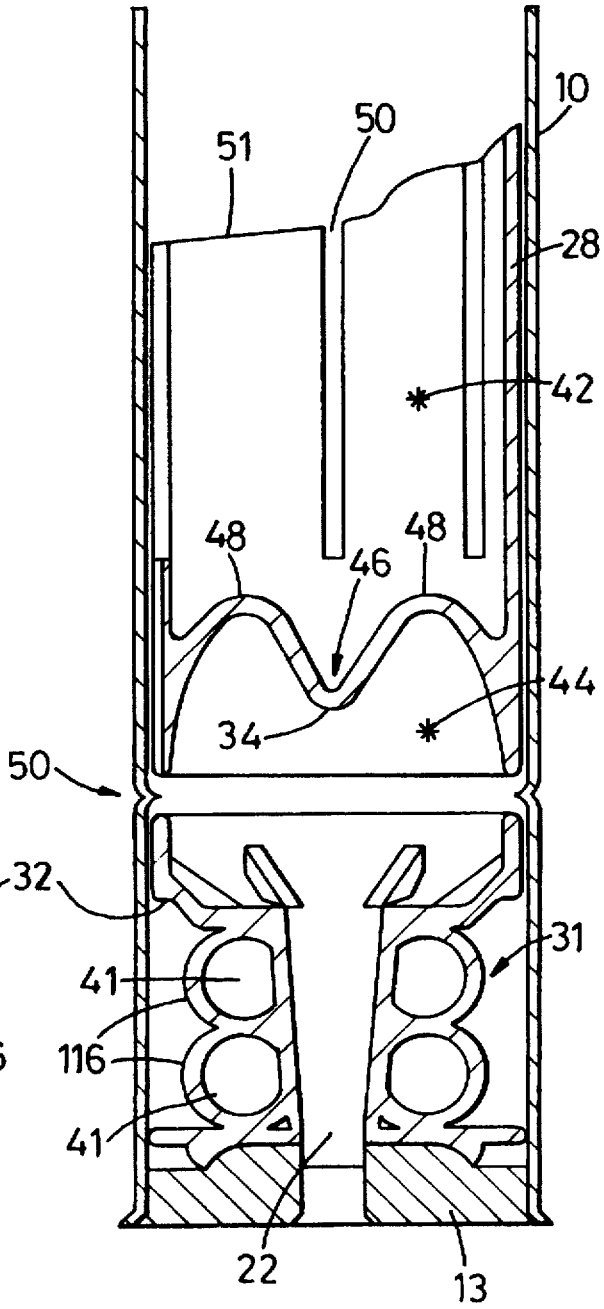

With reference to FIGS. 10 to 12, here will be described a fourth embodiment of the invention. A forward jacket portion 28 consists of a generally cylindrical structure 40 divided into a shot retaining portion 42 and a charge retaining portion 44 by a dividing portion 46. As described earlier with reference to FIG. 2, the dividing portion 46 has a member 34 projecting into the charge retaining portion to promote uniform distribution of flames from the primer (not shown).

The dividing member further has an axially centred, annular projection 48 which extends into the shot-retaining portion 42, and a central, generally conical projection 34 which extends into the charge-retaining portion 44.

Additionally, there is provided a charge support 31 disposed between the cartridge base 13 and the jacket portion 28. The charge support 31 (which is separate from the jacket portion 28) comprises a platform member 32 into which the charge is received which is supported on a recoil-absorbing structure which is, in turn, carried on the base plate. The recoil absorbing structure comprises two toric members 116 of resilient material in each of which is an air space 41. A duct 22 extends axially through the cartridge base 13 and the toric members 116 to provide a flame path between a primer (not shown in FIGS. 10 to 12) and the platform member 32.

Figure 10A:
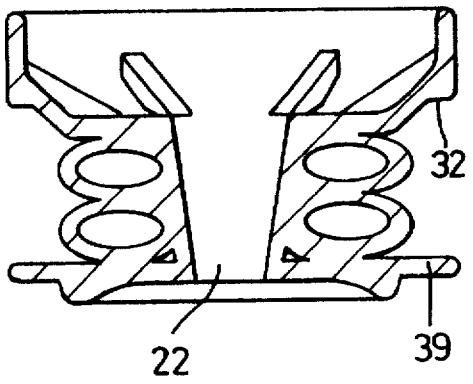
FIG. 10A shows part of the embodiment of FIG. 10 following firing of a charge.

When the cartridge of this embodiment is discharged, recoil energy is absorbed by resilient compression of the toric members 116 (as shown in FIG. 10A), so reducing the recoil transmitted to the weapon itself.

FIGS. 11 and 12 illustrate alternative constructions of cartridges embodying the above described components.

As shown in FIG. 11, the charge support 31 could be formed integrally with the base plane of the cartridge. This is made possible since the reduction in recoil forces resulting from the invention allows the base plate to be formed from a wider range of materials (including, for example, plastics, which may, for example, be drawn or injection moulded) than hitherto possible.

Alternatively, as shown in FIG. 12, a substantially conventional base plate 13 may he used. In this case, it is highly desirable to provide means to anchor the charge support 31 in the cartridge case. With reference to FIG. 12, this may be achieved by forming an inwardly-directed nip 50 in the case, the internal diameter of which is too small to allow the charge support 31 to pass freely therethrough. Alternatively, a dovetail formation (as described above) may be employed to this end.

I claim:

1. A round of munition comprising a casing, and a base, within the casing there being contained a charge, and at least one projectile forward of the charge and a gap between the base and the charge, the gap being at least partially occupied by a charge support which separates the charge from the base, wherein on discharge of the round the charge support undergoes compressive deformation, characterized in that the charge support incorporates a plurality of hollow, air filled formations which undergo resilient or crushing deformation on discharge of the round, the air filled formations being defined as tubular members entirely within the charge support, the tubular members being spaced from an inner wall of the casing and from a rearward end of the charge support.

2. A round of ammunition according to claim 1 in which the formations are disposed between a platform member in contact with the charge and the base of the round.

3. A round of ammunition according to claim 2 in which the formations are disposed in line between the platform member and the base.

4. A round of ammunition according to claim 3 in which either two or three of the formations are disposed between the base and the platform member.

5. A round of ammunition according to claim 1 in which the charge support is an injection moulding of plastics material.

6. A round of ammunition according to claim 1 in which the charge support and the base of the round are formed as one piece.

7. A round of ammunition according to claim 1 in which the charge support is a discrete component which is inserted into the casing, retention means for retaining it therein being provided.

8. A round of ammunition according to claim 7 in which the retention means comprises interlocking formations on the charge support and on the base of the round.

9. A round of ammunition according to claim 7, in which the retention means comprises a region of reduced diameter of the casing of the round.

10. A round of ammunition according to claim 1 further comprising a jacket portion within the casing, the jacket portion having a dividing wall which is disposed between the charge and the at least one projectile.

11. A round of ammunition according to claim 10 in which the dividing wall has a formation which projects into the charge to provide uniform distribution of combustion therein.

12. A round of ammunition according to claim 10 in which the jacket portion has a generally cylindrical shot retaining portion extending forwardly of the dividing wall.

13. A round of ammunition according to claim 10 in which the jacket portion is a close fit within the casing of the round.

14. A round of ammunition according to claim 13 in which a primer is mounted in base of the round, there being a duct extending through the charge support to guide flames from the primer towards the charge.

15. A round of ammunition according to claim 14 in which the duct tapers towards the primer.

16. A shotgun cartridge comprising:

a casing; a base; a charge contained within the casing; a plurality of projectiles forward of the charge; a gap within the casing between the base and the charge; and a charge support contained within the gap which separates the charge from the base, which charge support comprises a plurality of hollow, air-filled, tubular formations which are separate from an inner wall of the casing, the tubular formations being spaced from a rearward end of the charge support, and which are successively and adjacently interconnected, whereby on discharge of the round, the charge support undergoes compressive deformation, and the tubular formations undergo resilient or crushing deformation.

* * * * *

UNITED STATES PATENT AND TRADEMARK OFFICE

CERTIFICATE OF CORRECTION

PATENT NO. : 5,710,391
DATED : January 20, 1998
INVENTOR(S) : Francis Chetcuti, et al.

It is certified that error appears in the above-identified patent and that said Letters Patent is hereby corrected as shown below:

On the title page, item [30] Priority data should read –Oct. 12, 1993 [GK] 9321016.9--

Column 4, line 60, delete "munition" should read --ammunition--

Signed and Sealed this

Eighth Day of September, 1998

*Attest:*

Bruce Lehman

BRUCE LEHMAN

*Attesting Officer*

*Commissioner of Patents and Trademarks*